United States Patent [19]

Mortensen et al.

[11] 4,148,238

[45] Apr. 10, 1979

[54] WRAPPER ROLLING MACHINE FOR CIGARS AND SIMILAR TOBACCO PRODUCTS

[75] Inventors: Niels E. Mortensen, Slagelse; Bent E. Christiansen, Klarup; Ian Kjaer, Hadsund, all of Denmark

[73] Assignee: A/S Skandinavisk Tobakskompagni, Denmark

[21] Appl. No.: 812,677

[22] Filed: Jul. 5, 1977

[30] Foreign Application Priority Data

Jul. 12, 1976 [DK] Denmark ..... 3147/76

[51] Int. Cl.[2] ..... A24C 1/04

[52] U.S. Cl. ..... 83/152; 83/154; 83/167; 83/451; 83/512

[58] Field of Search ..... 83/152, 157, 167, 451, 83/510, 511, 512, 154

[56] References Cited

U.S. PATENT DOCUMENTS

| | | | |
|---|---|---|---|
| 511,001 | 12/1893 | Warnken | 83/510 |
| 596,467 | 1/1898 | Baker | 83/511 |
| 3,191,473 | 6/1965 | Maas et al. | 83/512 X |

FOREIGN PATENT DOCUMENTS

| | | | |
|---|---|---|---|
| 53497 | 11/1942 | Netherlands | 83/511 |

*Primary Examiner*—J. M. Meister

*Attorney, Agent, or Firm*—Stevens, Davis, Miller & Mosher

[57] ABSTRACT

In a wrapper rolling machine for the manufacture of cigars etc. and comprising a wrapper cutting out unit, means are provided to hold one half of a tobacco leaf while cutting is performed in its other half, and to deliver the first half, together with any scraps appending thereto, in a plane condition and a desired orientation for the subsequent cutting out of one or more wrappers from said first half.

5 Claims, 1 Drawing Figure

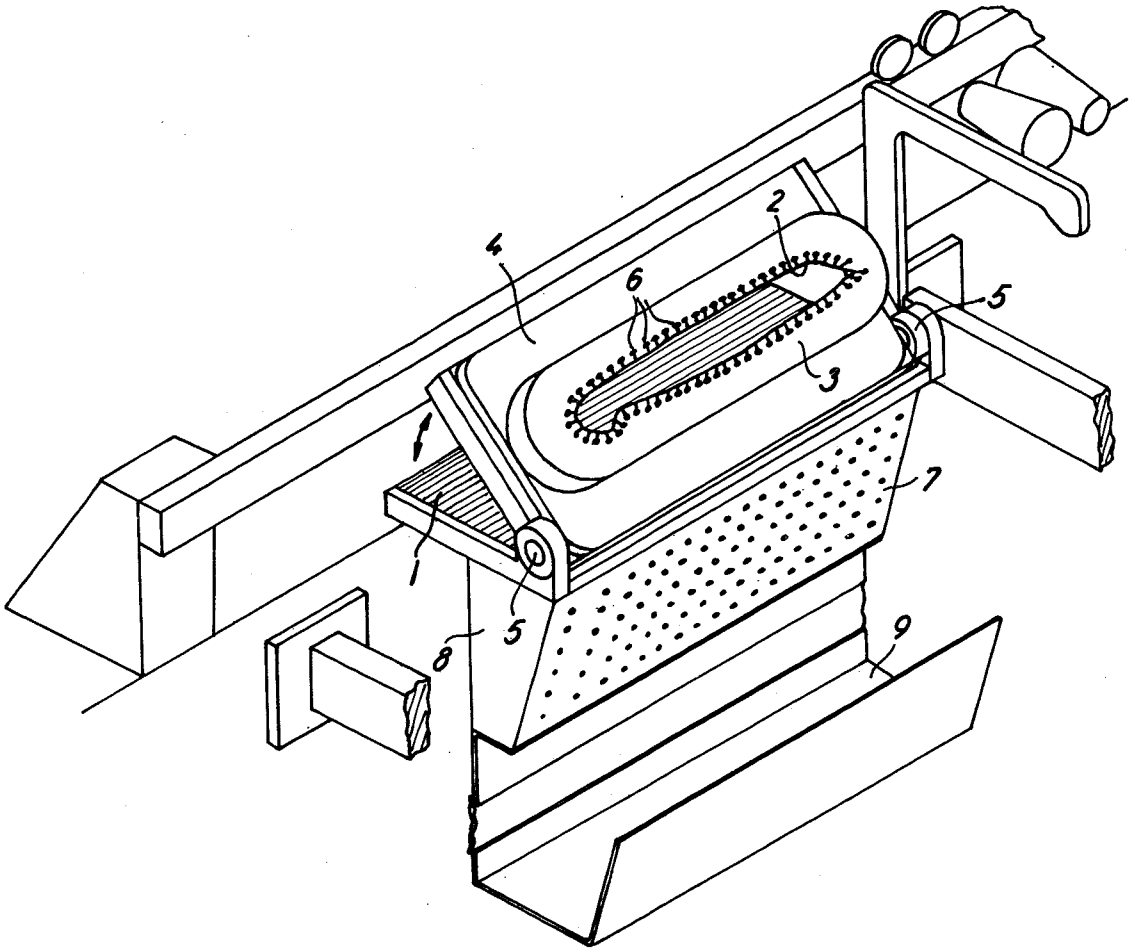
1
2
3
4
5
5
6
7
8
9

WRAPPER ROLLING MACHINE FOR CIGARS AND SIMILAR TOBACCO PRODUCTS

BACKGROUND OF THE INVENTION

In the mechanical production of cigars, cheroots and similar tobacco products, use in made of wrapper rolling machines for cutting out the wrapper and applying it to the filler or bunch supplied to the same machine. As the wrapper plays an important role for the quality of the finished cigar with regard to flavour and appearance, selected tobacco leaves have to be used for this purpose, and according to usual practice, after having been suitably moistened and smoothed or spread in appropriate machines or devices these leaves are stripped or torn through along their central rib. Concurrently therewith any damaged tobacco leaves can be sorted out, and the leaves which shall be supplied to the wrapper rolling machines can be turned so as to lie in stacks with the same side (face or back) upwards. Such a stack can suitably comprise 20–50 leaves, or more correctly half-leaves, as the right sides and the left sides have to be applied by rolling in separate machines in order that the remaining side ribs of the leaves can have both a uniform position (external or internal) and a uniform orientation (mainly in the longitudinal direction of the cigar), in all the cigars produced.

In spite of the high costs in connection both with the spreading and stripping or tearing through of the leaves in a special section of the factory, and with the additional internal transport thus required, this process of manufacture has so far been regarded as necessary in view of the optimum utilization of the wrapper rolling machines themselves, whose capacity in practice is primarily determined by the rate at which the operator can cut out the wrappers from the prepared half-leaves.

In the conventional rolling machines the cutting device comprises a stationary cutting knife having an upwardly directed edge and a roller cooperating with said knife, as well as a shield that surrounds the knife and is pressed slightly back (downwards) by the roller so as to uncover the knife. The knife as well as the shield may be provided with suction apertures for holding the leaf by vacuum during the cutting operation. After said operation, the partial vacuum is suspended and the cut wrapper is transferred by means of a swinging arm to the rolling mechanism, while the operator rearranges the remainder of the leaf for cutting out a further wrapper, if this is possible. At the end, the useless scraps of the tobacco leaf are blown away while the operator takes the next leaf and arranges it in the cutting device.

The present invention is based upon the recognition that it is possible, by making comparatively small modifications in the conventional wrapper rolling machines, to achieve a sequence of operation or a program of manufacture requiring less manual labour and thus making possible a reduction in the total production cost.

SUMARY OF THE INVENTION

Thus the invention relates to a wrapper rolling machine for the manufacture of cigars and similar tobacco products and of the known type comprising a unit for cutting out wrappers from spread tobacco leaves, said unit including a cutting knife and a knife surrounding shield, which serves as a support for the remainder of the tobacco leaf and is provided with suction apertures for holding the leaf by vacuum before and during the cutting operation.

The aim of the invention has been to improve machines of this type in such a manner that whole or unstripped tobacco leaves may be used as starting material, without complicating or delaying to any appreciable extent the work of the operator.

For this purpose the wrapper rolling machine according to the invention is characterized by means which, after the cutting out of one or more wrappers from the tobacco leaf on one side of its central rib and after suspension of the holding vacuum, are operative to deliver the remaining half of the tobacco leaf in a plane condition and with the desired orientation with a view to the subsequent cutting out of one or more wrappers from the tobacco leaf on the other side of its central rib.

With a machine arranged in this manner, the operator can, as indicated, start with whole tobacco leaves, which thus need not be stripped or torn through and, consequently, need not either be subjected to a previous spreading. The duty of the operator is still to carry out the cutting of wrappers in the same manner as before, but only from one half, the right or left half, of the tobacco leaves, the second half with the central rib and possible attached cutting scraps being delivered in good order for a similar cutting operation in another wrapper rolling machine or possibly for subsequent treatment in the same machine. This latter possibility can in particular be considered when it is of minor importance whether the wrapper is applied with one or the other of its faces outside, whereas it is desired to have the prodominant side ribs oriented in the longitudinal direction of the cigar. If, as is often the case, it is desired that this condition is fulfilled and that the generally lighter back face of the wrapper is turned outwards, the two half-leaves on either side of the central rib have to be cut out and rolled in separate machines, a "right" and a "left" machine, respectively.

The main advantage of the invention is that it renders superfluous a previous stripping or tearing through of the tobacco leaves, and that consequently much preparatory work may be saved in connection with the tobacco leaves to be supplied to the wrapper rolling machine.

In practice the said advantages can suitably be achieved by making the shield of the cutting unit tiltable about a horizontal axis to a delivery position for the remaining half of the tobacco leaf. The tilting movement can easily be initiated by the operator at the right moment, and by suspending the suction this half-leaf may be released so that is can slide down the shield by the force of gravity, possibly assisted by an air current or by the operator. From said shield the half-leaf can fall down on a conveyor, or on the side of the cutting unit facing the operator a collecting tray may be provided for receiving the half-leaves released from the shield. These halves can settle in a well-arranged stack in the tray and then be easily available for further treatment.

Under the shield a suction box may be provided having a perforated front wall against which the remaining half of the tobacco leaf is held by vacuum during the cutting operation and till shortly after the release of the leaf from the shield. This measure makes it easier for the operator to stretch the leaf over the cutting knife and it may also contribute to the well-arranged stacking of the remaining leaves in the collecting tray.

BRIEF DESCRIPTION OF THE PREFERRED EMBODIMENT

An embodiment of the wrapper rolling machine according to the invention is illustrated in the drawing, which only shows the relevant parts of the machine in question, the other parts of which can be of conventional type.

A cutting table 1 carries a cutting knife (not visible) of same outline as the opening 2 in a shield 3 carried by a plate 4 which through bearings 5 having a common horizontal axis is connected with the table 1, so that the plate, as indicated by the double arrow, can tilt between the inclined position shown and a horizontal position. In this latter position the knife projects slightly through the opening 2 of the shield and makes possible the cutting out of a wrapper in a conventional manner along one lateral edge of a tobacco leaf. During this operation said leaf is held to the shield 3 by suction through a number of apertures 6 distributed around the opening 2. The cutting is carried out only in one half of the tobacco leaf, i.e., on one side of its central rib, the other half of the leaf during the cutting being held against the perforated front wall 7 by a suction box 8 situated under the cutting device.

After cutting out of the possible number of wrappers from one half of the tobacco leaf, the suction through the apertures 6 in the shield is suspended and said shield is tilted up in the position shown, while partial vacuum is still maintained in the suction box 8. The cutting scraps from the first half leaf slide down or are blown away from the shield 3, and after suspension of the partial vacuum in the suction box the remaining part of the leaf falls down in a collecting tray 9 and in so doing is turned so that the side facing the wall 7 is turned upwards. Correctly turned half-leaves, possibly with attached cutting scraps, form in this manner a well-arranged stack in the tray 9, and from these half-leaves further wrappers can later on be cut out in a conventional manner.

As indicated above, the remaining half-leaves need not be stacked in a tray or a similar receptacle; they can from the shield 3 be transferred to a conveyor which will carry them direct to a next cutting unit. Also in that case use can be made of a tilting shield as shown in the drawing, but the remaining half-leaves may also be transferred to the conveyor in another manner, suitably by means of a suction head mounted on a swinging arm, like the one commonly used for transferring the cut wrappers to the rolling unit of the machine.

What is claimed is:

1. Apparatus for cutting wrappers, to be fed to a wrapper rolling machine, from unstripped tobacco leaves, comprising a cutting knife, a knife surrounding shield for firmly holding and supporting a first half of each tobacco leaf around the periphery of said knife during the cutting of at least one wrapper from said first half on one side of the central rib of the leaf, means for holding the second half of the tobacco leaf in a substantially planar condition during the cutting operation, said knife surrounding shield being mounted on top of a suction box structure presenting a perforated front wall forming said holding means, said shield being tiltable on a horizontal axis adjacent said front wall between a substantially horizontal operative position and an inclined release position, and said collecting means being a tray below said front wall, and means for collecting the second halves of the leaves in stack formation ready for a subsequent cutting of wrappers from these second halves.

2. Apparatus for cutting wrappers from an unstripped tobacco leaf comprising:

(a) a generally horizontal cutting table carrying a cutting knife;

(b) a plate mounted along one edge of the cutting table for pivotal movement in relation thereto between a substantially horizontal operative position and an inclined release position; said plate carrying a knife surrounding shield having a plurality of suction apertures for firmly supporting first half of a tobacco leaf around the periphery of said knife during the cutting of a wrapper from one side of the central rib of the leaf;

(c) a generally vertically extending wall below said one edge of the cutting table having a plurality of suction apertures to act as means for holding the second half of the tobacco leaf in a substantially plane condition during the cutting operation;

(d) a collecting tray below said generally vertically extending wall.

3. Apparatus for cutting wrappers, to be fed to a wrapper rolling machine, from unstripped tobacco leaves, comprising a cutting knife, a knife surrounding shield for firmly holding and supporting a first half of each tobacco leaf around the periphery of said knife during the cutting of at least one wrapper from said first half on one side of the central rib of the leaf, said knife surrounding shield being mounted on top of a suction box structure which has a perforated area on its front for holding the remainder of the tobacco leaf including the second half thereof during the cutting operation, and means provided in front of said suction box and below the level of said shield for collecting the second halves of the leaves in stack formation ready for a subsequent cutting of wrappers from these second halves.

4. Apparatus as claimed in claim 3, wherein said knife surrounding shield is tiltable on a horizontal axis adjacent a front edge of said suction box between a substantially horizontal operative position and an inclined release position.

5. Apparatus as claimed in claim 3, wherein said perforated area is a generally vertically extending wall for holding the second half of the tobacco leaf in a substantially planar condition during the cutting operation, said collection means being a tray below said generally vertically extending front wall.

* * * * *